US005671831A

United States Patent [19]

Chiu

[11] Patent Number: 5,671,831

[45] Date of Patent: Sep. 30, 1997

[54] ADJUSTABLE TRAVEL BAG

[76] Inventor: Tai-Yung Chiu, P.O. Box 82-144, Taipei, Taiwan

[21] Appl. No.: 614,651

[22] Filed: Mar. 13, 1996

[51] Int. Cl.[6] ..... A45C 7/00; A45C 13/04; A45C 13/36

[52] U.S. Cl. ..... 190/103; 190/104; 190/24; 190/127; 190/903; 383/2

[58] Field of Search ..... 190/103–105, 190/107, 127, 24, 15 R, 903, 122; 383/2

[56] References Cited

U.S. PATENT DOCUMENTS

| | | | |
|---|---|---|---|
| 764,144 | 7/1904 | McGowan | 190/105 |
| 2,079,476 | 5/1937 | Saling | 190/105 |
| 2,710,084 | 6/1955 | Braverman | 190/127 X |
| 2,729,257 | 1/1956 | Kepper | 383/2 |
| 3,504,772 | 4/1970 | Barry | 190/105 |
| 4,334,601 | 6/1982 | Davis | 190/161 X |
| 4,598,802 | 7/1986 | Abenaim | 190/127 X |
| 5,307,908 | 5/1994 | Shyr et al. | 190/103 X |

FOREIGN PATENT DOCUMENTS

| | | | |
|---|---|---|---|
| 171309 | 5/1952 | Austria | 190/104 |
| 1185339 | 3/1970 | United Kingdom | 190/103 |
| 1208113 | 10/1970 | United Kingdom | 190/103 |
| 2173393 | 10/1986 | United Kingdom | 190/104 |

*Primary Examiner*—Sue A. Weaver
*Attorney, Agent, or Firm*—Alfred Lei

[57] ABSTRACT

An adjustable travel bag which includes a main bag body having a front open side and an endless, strap-like folding collapsible coupling panel around the front open side, and an auxiliary bag body openably fastened to the coupling panel of the main bag body by a main zipper to close/open the front open side of the main bag body, wherein the coupling panel of the main bag body has two rows of interlocking teeth fixedly mounted along two opposite side edges thereof and unfastenably fastened together by a slide to secure the coupling panel in a folded up condition to minimize the holding space of the main bag body.

1 Claim, 4 Drawing Sheets

ADJUSTABLE TRAVEL BAG

BACKGROUND OF THE INVENTION

The present invention relates to travel bags, and relates more particularly to an adjustable travel bag which can be adjusted to change its holding space.

When traveling, travel bags are commonly used to carry one's clothes and personal accessories. Because regular travel bags cannot be adjusted to change the holding space, different sizes of travel bags may be used subject to the amount of things to be carried. Therefore, people shall have to prepare several travel bags of different sizes for use on different occasions. However, it is not economic to prepare a lot of travel bags of different sizes just for use on few occasions.

SUMMARY OF THE INVENTION

The present invention has been accomplished under the circumstances in view. It is the main object of the present invention to provide an adjustable travel bag which can be conveniently adjusted to change its holding space subject to the quantity of the things to be carried.

According to one aspect of the present invention, the adjustable travel bag comprises main bag body having a front open side and an endless, strap-like folding collapsible coupling panel around the front open side, and an auxiliary bag body openably fastened to the coupling panel of the main bag body by a main zipper to close/open the front open side of the main bag body, wherein the coupling panel of the main bag body has two rows of interlocking teeth fixedly mounted along two opposite side edges thereof and unfastenably fastened together by a slider to secure the coupling panel in the collapsed position to minimize the holding space of the main bag body. According to another aspect of the present invention, a retractable plate is fixedly secured to the folding collapsible coupling panel of the main bag body and moved in and out of a bottom board thereof for guiding folding collapsible coupling panel between the extended out position and the collapsed position.

DETAILED DESCRIPTION OF THE PREFERRED EMBODIMENT

Figure 1:
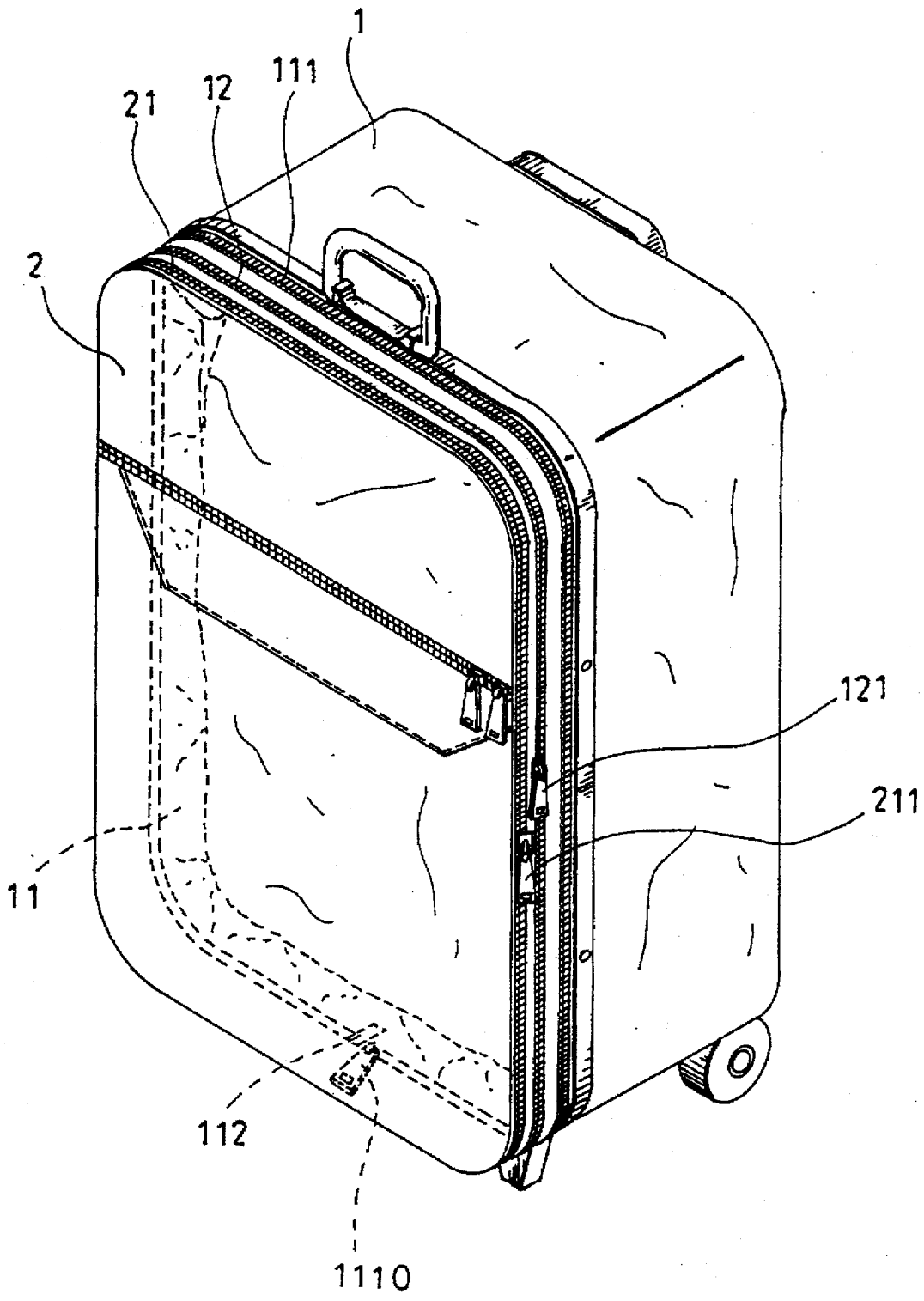
FIG. 1 is a perspective view of an adjustable travel bag according to the present invention, showing the folding collapsible coupling panel of the main bag body collapsed.
Figure 2:
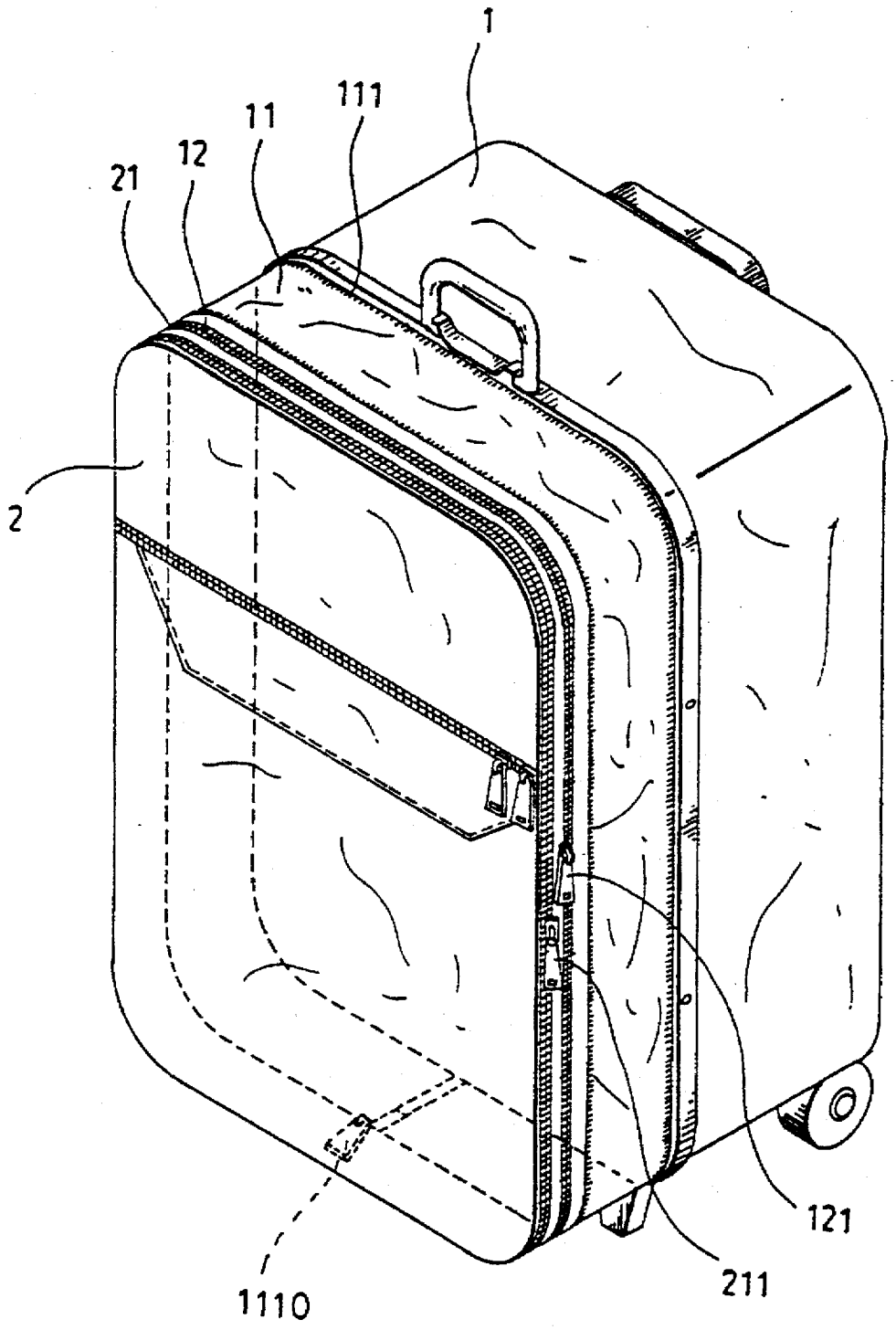
FIG. 2 is similar to FIG. 1 but showing the folding collapsible coupling panel of the main bag body extended out.
Figure 3:
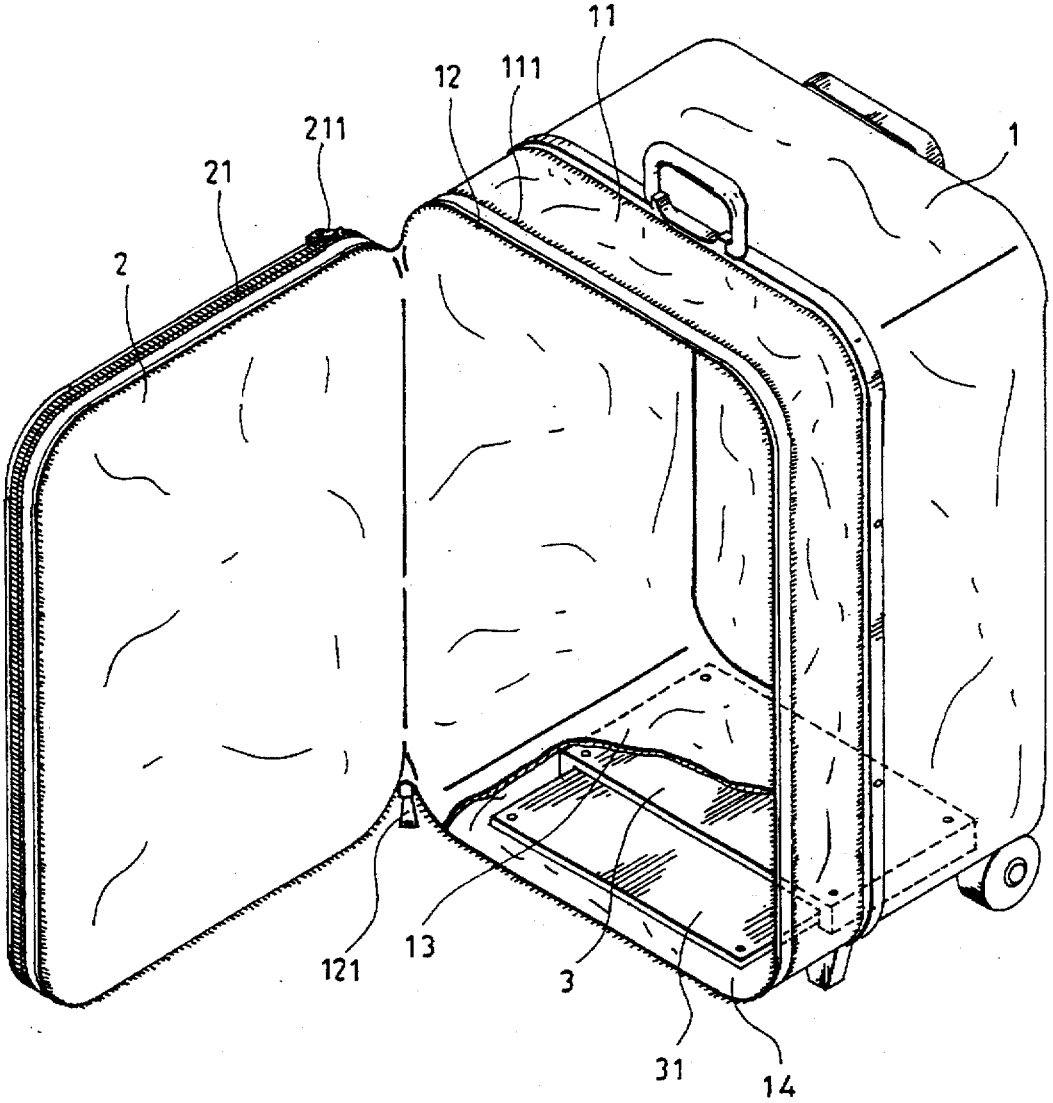
FIG. 3 is an open view of the adjustable travel bag of FIG. 2, showing the retractable plate mounted in the bottom side of the main bag body.

Referring to FIGS. 1, 2, and 3, an adjustable travel bag in accordance with the present invention is generally comprised of a main bag body 1, and an auxiliary bag body 2. The auxiliary bag body 2 defines an enclosed space sealed by a zipper 21 for holding clothes and personal accessories. The auxiliary bag body 2 can be opened and closed by sliding the slider 211 of the zipper 21. The main bag body 1 is an open container of rectangular shape, having a front open side closed by the auxiliary bag body 2 by means of a zipper 12. The auxiliary bag body 2 fits over the front open side of the main bag body 1, having one side edge fixedly fastened to one side edge of the front open side of the main bag body 1. The other three side edges of the auxiliary bag body 2 and the other three side edges of the front open side of the main bag body 1 can be fastened together by sliding the slider 121 of the zipper 12. FIG. 3 shows the zipper 12 unfastened, and the auxiliary bag body 2 opened from the main bag body 1. The main bag body 1 comprises an endless, strap-like folding collapsible coupling panel 11 around the front open side, which is connected to the auxiliary bag body 2. A zipper 111 is fastened to the folding collapsible coupling panel 11 adjacent to its two opposite side edges (i.e., the two rows of interlocking teeth of the zipper 111 are respectively fixed to the folding collapsible coupling panel 11 along its two opposite side edges). A rigid bottom board 3 is peripherally fastened to the bottom panel 14 of the main bag body 1 on the inside, and a retractable plate 31 is moved in and out of the space defined between the bottom panel 14 and the bottom board 3. The retractable plate 31 has a front side fixedly secured to the collapsible coupling panel 11. When the bottom board 3 and the retractable plate 31 are installed, a lining 13 is fastened to the inside of the main bag body 1 and covered over the bottom board 3 and the retractable plate 31. By sliding the slider 1110 of the zipper 111 to fasten its two rows of interlocking teeth together, the folding collapsible coupling panel 11 is folded up and fixed in the collapsed condition in which the width of the folding collapsible coupling panel 11 is minimized, and the holding space of the main bag body 1 is minimized (see FIG. 1). On the contrary, by sliding the slider of the zipper 111 to unfasten its two rows of interlocking teeth, the collapsible coupling panel 11 is extended out, and the holding space of the main bag body 1 is maximized (see FIG. 2).

Figure 4:
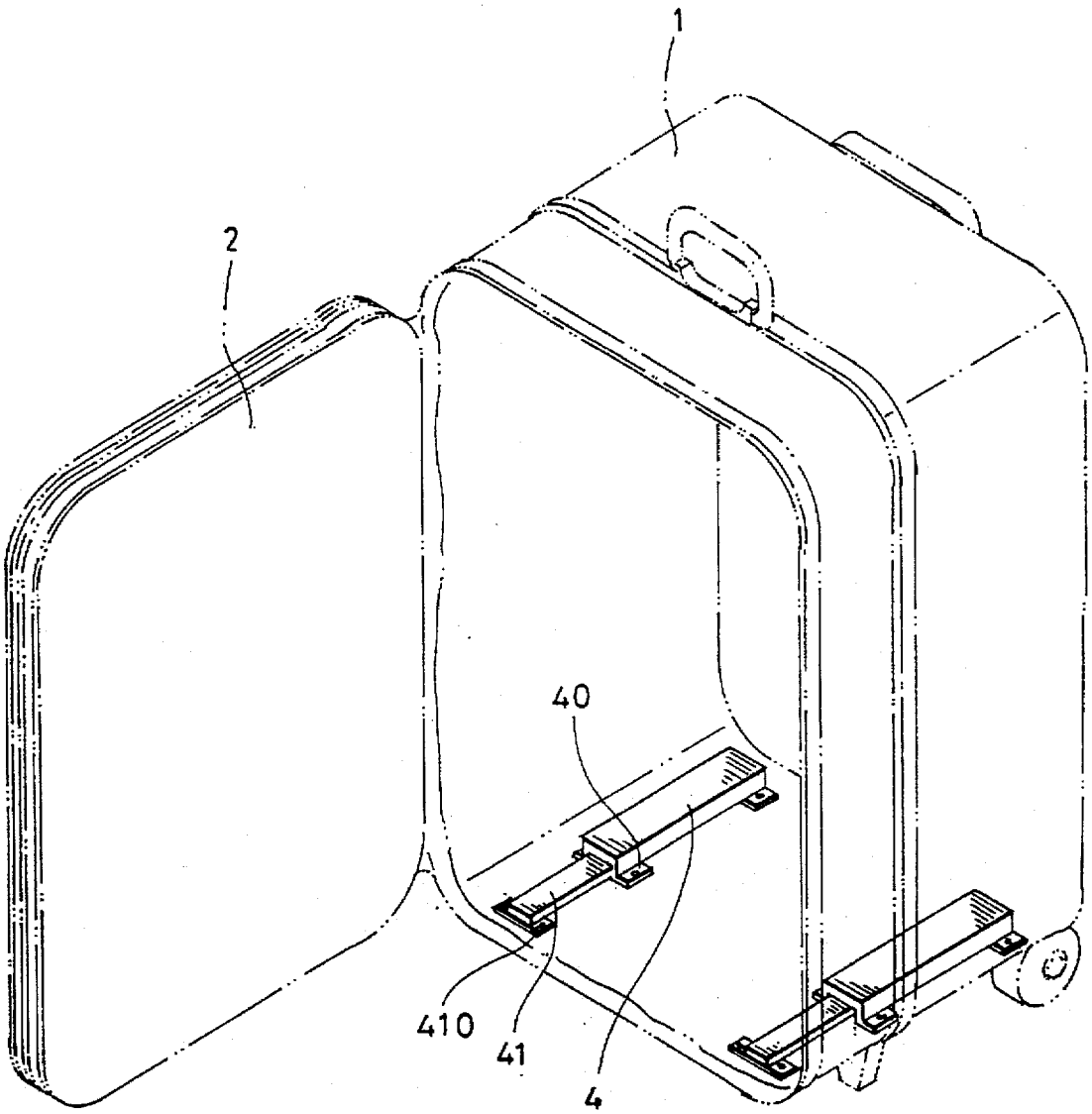
FIG. 4 is an open view of an alternate form of the adjustable travel bag of the present invention, showing two sliding bars fastened to the folding collapsible coupling panel and moved out of the tracks inside the main bag body.

FIG. 4 shows an alternate form of the present invention in which the tracks 40 have respective pairs of mounting lugs 410 at two opposite ends respectively fastened to the bottom panel 14 of the main bag body 1 on the inside by rivets, two sliding bars are respectively moved in and out of the tracks 40, each of the sliding bars 41 having a pair of mounting lugs 410 at the front end respectively fastened to the folding collapsible coupling panel 11 of the main bag body 1 by rivets. Therefore, the folding collapsible coupling panel 11 can be folded up and secured in the collapsed condition by fastening up the two interlocking teeth of the zipper 111.

What the invention claimed is:

1. An adjustable travel bag comprising a main bag body having a front open side, and an auxiliary bag body openably fastened to said main bag body by a main zipper to close/open the front open side of said main bag body, wherein said main bag body comprises an endless, strap-like folding collapsible coupling panel around the front open side and connected to said auxiliary bag body by said main zipper, said coupling panel having two rows of interlocking teeth fixedly mounted along two opposite side edges thereof and unfastenably fastened together by a slider to secure said coupling panel in a collapsed position so as to minimize holding space of said main bag body, a rigid bottom board peripherally fastened to a bottom panel of said main bag body on the inside, a retractable plate arranged movably in and out of a space defined between said bottom panel and said rigid bottom board, said retractable plate having a front side fixedly secured to said collapsible coupling panel, and a lining fastened to inside of said main bag body and covered over said bottom board and said retractable plate.

* * * * *